US008251031B2

(12) United States Patent
Tsubakino et al.

(10) Patent No.: US 8,251,031 B2
(45) Date of Patent: Aug. 28, 2012

(54) ROCKER SHAFT SUPPORT STRUCTURE IN FOUR-CYCLE ENGINE

(75) Inventors: Yukihiro Tsubakino, Saitama (JP); Shinsuke Yasui, Saitama (JP); Isao Azumagakito, Saitama (JP); Dai Koike, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 701 days.

(21) Appl. No.: 12/394,981

(22) Filed: Feb. 27, 2009

(65) Prior Publication Data

US 2009/0241880 A1 Oct. 1, 2009

(30) Foreign Application Priority Data

Mar. 31, 2008 (JP) ..... 2008-092717

(51) Int. Cl.
*F01L 1/18* (2006.01)

(52) U.S. Cl. ..... 123/90.39; 74/559; 74/569

(58) Field of Classification Search ..... 123/90.39, 123/90.27, 90.28, 90.38; 74/559, 569
See application file for complete search history.

(56) References Cited

U.S. PATENT DOCUMENTS 5,531,194 A * 7/1996 Komatsu et al. ..... 123/193.5
6,708,658 B2 * 3/2004 Takahashi et al. ..... 123/90.27
2001/0027764 A1 * 10/2001 Tanaka et al. ..... 123/90.28

FOREIGN PATENT DOCUMENTS

JP 2004-100651 A 4/2004

* cited by examiner

*Primary Examiner* — Zelalem Eshete
(74) *Attorney, Agent, or Firm* — Birch, Stewart, Kolasch & Birch, LLP

(57) ABSTRACT

In a four-cycle engine, the stiffness of a rocker shaft support portion is increased while avoiding an increase in the size of a cylinder head. The rocker shaft support portion that supports a rocker shaft is integrally formed on the cylinder head so as to be disposed between an engine valve and a camshaft as viewed from an axial direction of the camshaft and the rocker shaft. First reinforcement ribs are integrally disposed in a protruding condition on a plane orthogonal to an axis of a rocker shaft on a side face of rocker shaft support portions opposite a side of a camshaft.

19 Claims, 7 Drawing Sheets

ROCKER SHAFT SUPPORT STRUCTURE IN FOUR-CYCLE ENGINE

CROSS-REFERENCE TO RELATED APPLICATIONS

The present application claims priority under 35 USC 119 to Japanese Patent Application No. 2008-092717 filed on Mar. 31, 2008 the entire contents of which are hereby incorporated by reference.

BACKGROUND OF THE INVENTION

1. Field of the Invention

The present invention relates in general to a four-cycle engine having a rocker arm inserted between a valve actuating cam disposed on a camshaft and an engine valve, the rocker arm being rockably supported on a rocker shaft having an axis in parallel with the camshaft, and a rocker shaft support portion integrally formed on a cylinder head so as to be disposed between the engine valve and the camshaft as viewed from an axial direction of the camshaft and the rocker shaft, the rocker shaft support portion supporting the rocker shaft. More particularly, the present invention relates to an improved rocker shaft support structure.

2. Description of Background Art

A four-cycle engine is disclosed, for example, in Japanese Patent Laid-Open No. 2004-100651, in which an exhaust valve is driven to open or close by a rocker arm that rocks by being driven by rotation of an exhaust-side valve actuating cam disposed on a camshaft.

In such a four-cycle engine, enhancing stiffness of the rocker shaft support portion supporting the rocker shaft, on which a driving force from the side of the valve actuating cam and a reaction force from the engine valve act, is necessary for enhancing an operating response of the engine valve. To achieve that purpose, it is preferable to enhance the stiffness of the rocker shaft support portion without inviting an increase in the size of the cylinder head.

SUMMARY AND OBJECTS OF THE INVENTION

The present invention has been made under the foregoing circumstances and it is an object of an embodiment of the present invention to provide a rocker shaft support structure in a four-cycle engine that allows stiffness of a rocker shaft support portion to be enhanced while avoiding an increase in the size of the cylinder head.

To achieve the foregoing object, a rocker shaft support structure according to a first embodiment of the present invention is for a four-cycle engine. The four-cycle engine includes a rocker arm inserted between a valve actuating cam disposed on a camshaft and an engine valve, the rocker arm being rockably supported on a rocker shaft having an axis in parallel with the camshaft with rocker shaft support portions being integrally formed on a cylinder head so as to be disposed between the engine valve and the camshaft as viewed from an axial direction of the camshaft and the rocker shaft. The rocker shaft support portions are provided for supporting the rocker shaft. The rocker shaft support structure includes first reinforcement ribs that are integrally disposed in a protruding condition on a plane orthogonal to the axis of the rocker shaft on a side face of the rocker shaft support portions opposite a side of the camshaft.

According to a second embodiment of the present invention, a pair of the rocker shaft support portions are provided that rockably support both ends of the rocker shaft and are integrally formed on the cylinder head such that the rocker arm is disposed between the rocker shaft support portions. A second reinforcement rib is disposed on a plane that is in parallel with the axis of the rocker shaft and is integrally formed in a protruding condition on a side face of at least one rocker shaft support portion opposite a side of the rocker arm.

According to a third embodiment of the present invention, the cylinder head includes camshaft holders integrally formed thereon, the camshaft holders being integrally connected to the rocker shaft support portions with cam caps that are fastened to the camshaft holders, the cam caps cooperating with the camshaft holders to rotatably support the camshaft. Third reinforcement ribs are integrally formed on the cam caps in a protruding condition with the third reinforcement ribs protruding in a direction along the axis of the camshaft from portions of the cam caps fastened to the camshaft holders and abutting on the rocker shaft support portions.

According to a fourth embodiment of the present invention, the cylinder head further includes a rocker shaft center support portion integrally formed therewith between the rocker shaft support portions, the rocker shaft center support portion supporting the rocker shaft at an axial central portion thereof.

Note that the exhaust valves 41 and an exhaust-side valve actuating cam 53 are provided in embodiments of the present invention corresponds to the valve actuating cam.

In accordance with the first embodiment of the present invention, the first reinforcement ribs are integrally disposed in a protruding condition on the side face of the rocker shaft support portions opposite the side of the camshaft and on the plane orthogonal to the axis of the rocker shaft. This enhances the stiffness of the rocker shaft support portions, while avoiding an increase in size of the rocker shaft support portions and, for that matter, an increase in size of the cylinder head. This improves an operating response of the engine valve.

In accordance with the second embodiment of the present invention, the second reinforcement rib disposed on the plane that is in parallel with the axis of the rocker shaft is integrally formed in a protruding condition on the side face of at least one of the pair of rocker shaft support portions, between which the rocker arm is disposed, opposite the side of the rocker arm. This allows the second reinforcement rib to prevent the rocker shaft support portion from being tilted by a load acting on the rocker shaft from the rocker arm between the two rocker shaft support portions. Stiffness of the rocker shaft support portion can be enhanced with the structure that includes the second reinforcement rib integrated with the rocker shaft support portion in a protruding condition to thereby avoid making the size larger.

In accordance with the third embodiment of the present invention, the third reinforcement ribs that protrude in the direction along the axis of the camshaft from portions of the cam caps fastened to the camshaft holders that are disposed in the cylinder head so as to cooperate with the camshaft holders to rotatably support the camshaft are integrally formed on the cam caps in a protruding condition and abut on the rocker shaft support portions. The rocker shaft support portions can therefore be further reinforced with the third reinforcement ribs. Stiffness of the rocker shaft support portions can be further enhanced, so that the operating response of the engine valve can be further enhanced.

In accordance with the fourth embodiment of the present invention, the axial central portion of the rocker shaft is supported by the rocker shaft center support portion integrally formed on the cylinder head between the pair of rocker shaft support portions. This prevents the rocker shaft from being flexed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A specific embodiment to which the present invention is applied will be described below with reference to the accompanying drawings.

FIGS. 1 to 10 show an embodiment of the present invention.

Figure 1:
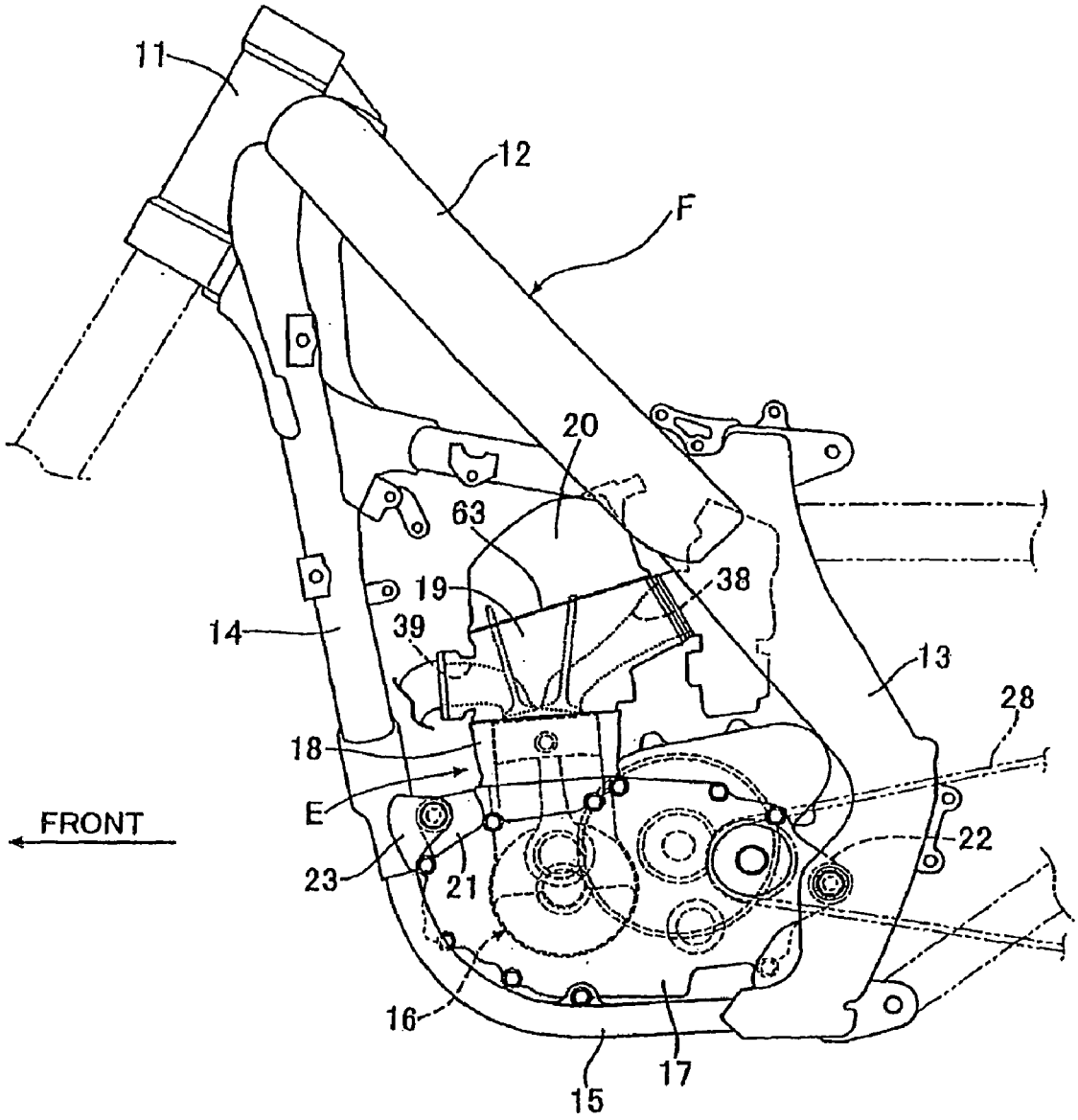
FIG. 1 is a side elevational view showing a four-cycle engine mounted in a vehicle body frame of a motorcycle.

As illustrated in FIG. 1, a cradle type vehicle body frame F for a motorcycle includes a head pipe 11, a main frame 12, a pivot plate 13, a down frame 14, and a lower frame 15. More specifically, the main frame 12 extends downwardly from the head pipe 11 toward the rear. The pivot plate 13 connected in a row arrangement to a rear portion of the main frame 12 extends downwardly. The down frame 14 is connected in a row arrangement to the head pipe 11 so as to extend downwardly toward the rear at an angle more acute than the main frame 12. The lower frame 15 is connected to a lower portion of the down frame 14 and extends rearwardly. The lower frame 15 is then connected to a lower portion of the pivot plate 13. A single-cylinder, four-cycle engine E is mounted in the vehicle body frame F.

Figure 2:
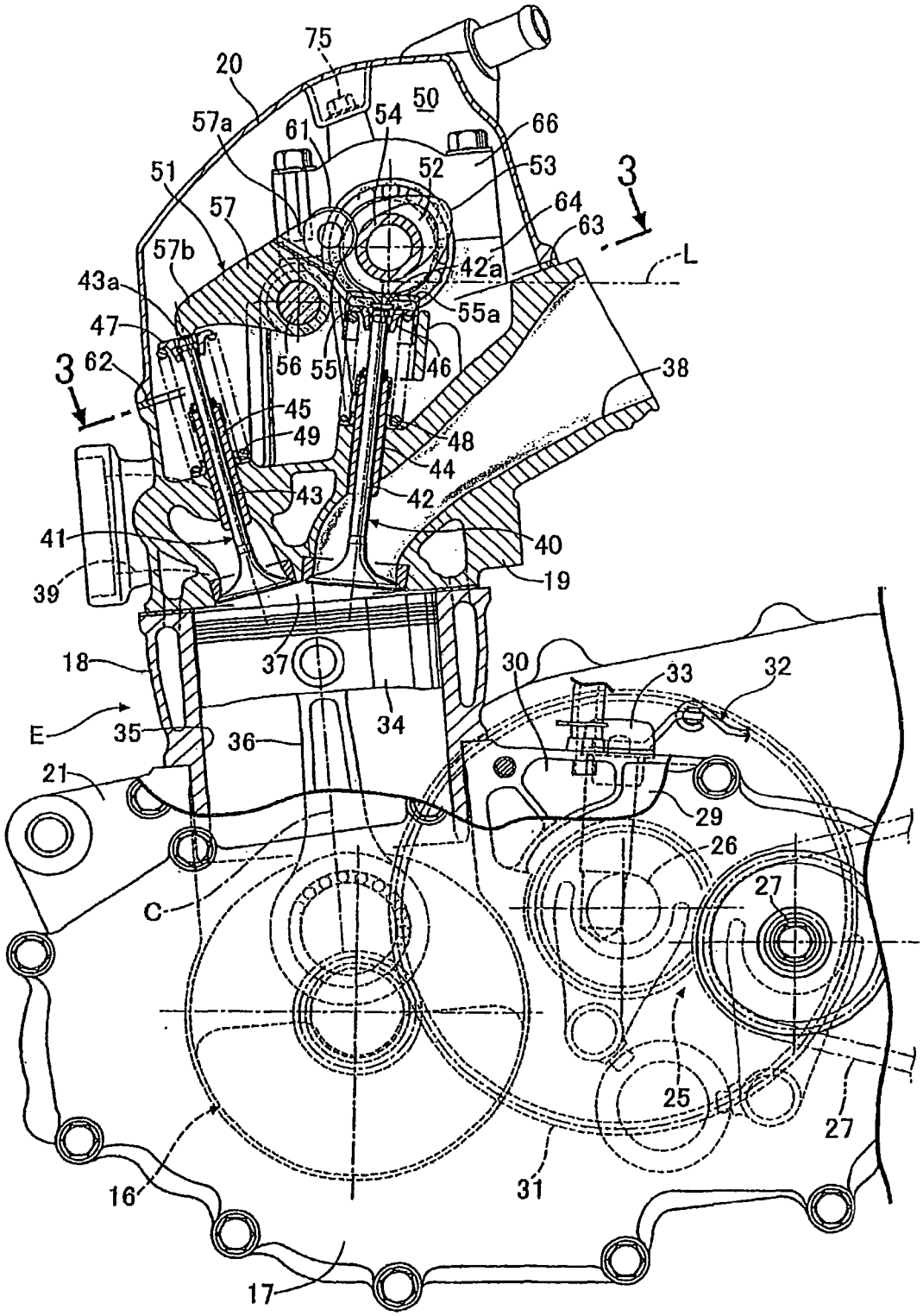
FIG. 2 is a partly cutaway, enlarged side elevational view showing the four-cycle engine as viewed from the same direction as in FIG. 1, partly cut away along line 2-2 of FIG. 3.

Referring also to FIG. 2, the four-cycle engine E includes a crankcase 17, a cylinder block 18, a cylinder head 19, and a head cover 20. The crankcase 17 rotatably supports a crankshaft 16 having an axis extending in a width direction of the motorcycle. The cylinder block 18 is connected to a front upper portion of the crankcase 17 and extends upwardly. The cylinder head 19 is connected to an upper portion of the cylinder block 18. The head cover 20 is connected to an upper portion of the cylinder head 19. A support portion 21 disposed at a front portion of the crankcase 17 is fastened to a bracket 23 disposed at a joint between the down frame 14 and the lower frame 15. A support portion 22 disposed at a rear of the crankcase 17 is fastened to the pivot plate 13.

A transmission 25 is built into a rear portion of the crankcase 17. More specifically, the transmission 25 includes a gear train of a plurality of shift speeds to be selectively established between a main shaft 26, to which power is transmitted from the crankshaft 16, and a countershaft 27 that can transmit power to the side of a rear wheel not shown via an endless chain 28.

A breather chamber 30 is formed at an upper portion of the crankcase 17 on the side of the cylinder block 18. The breather chamber 30 communicates with a transmission chamber 29 formed inside the crankcase 17 so as to accommodate therein the transmission 25. In addition, a clutch operation mechanism 32 and a cap 33 are disposed in the crankcase 17 so as to overlap the breather chamber 30 as viewed from a direction extending along the axis of the crankshaft 16. The clutch operation mechanism 32 connects or disconnects a clutch 31 disposed coaxially with the main shaft 26 so as to be inserted between the crankshaft 16 and the main shaft 26. The cap 33 openably closes a filler port through which oil is poured into the transmission chamber 29. The foregoing positional arrangements of the breather chamber 30, the clutch operation mechanism 32, and the cap 33 make for greater workability in pouring the oil in the transmission chamber 29, while achieving reduction in size of the engine E.

The cylinder block 18 has a cylinder bore 35 formed therein in which a piston 34 can be slidably fitted. The piston 34 is connected to the crankshaft 16 via a connecting rod 36. In addition, a combustion chamber 37 facing a top of the piston 34 is formed between the cylinder block 18 and the cylinder head 19. A single intake port 38 to be brought into communication with the combustion chamber 37 and a single exhaust port 39 to be brought into communication with the combustion chamber 37 are disposed in the cylinder head 19.

A pair of intake valves 40 and a pair of exhaust valves 41 are openably disposed in the cylinder head 19. The pair of intake valves 40 opens or closes a path between the combustion chamber 37 and the intake port 38. The pair of exhaust valves 41 opens or closes a path between the combustion chamber 37 and the exhaust port 39. Stems 42,43 included in the intake valves 40 and the exhaust valves 41, respectively, are slidably fitted into guide tubes 44, 45 disposed in the cylinder head 19. Valve springs 48, 49 are disposed between retainers 46, 47 disposed at stem ends 42*a*, 43*a* of the stems 42, 43, respectively and cylinder head 19. Spring forces exerted by the valve springs 48, 49 urge the intake valves 40 and the exhaust valves 41 in valve closing directions, respectively.

Figure 3:
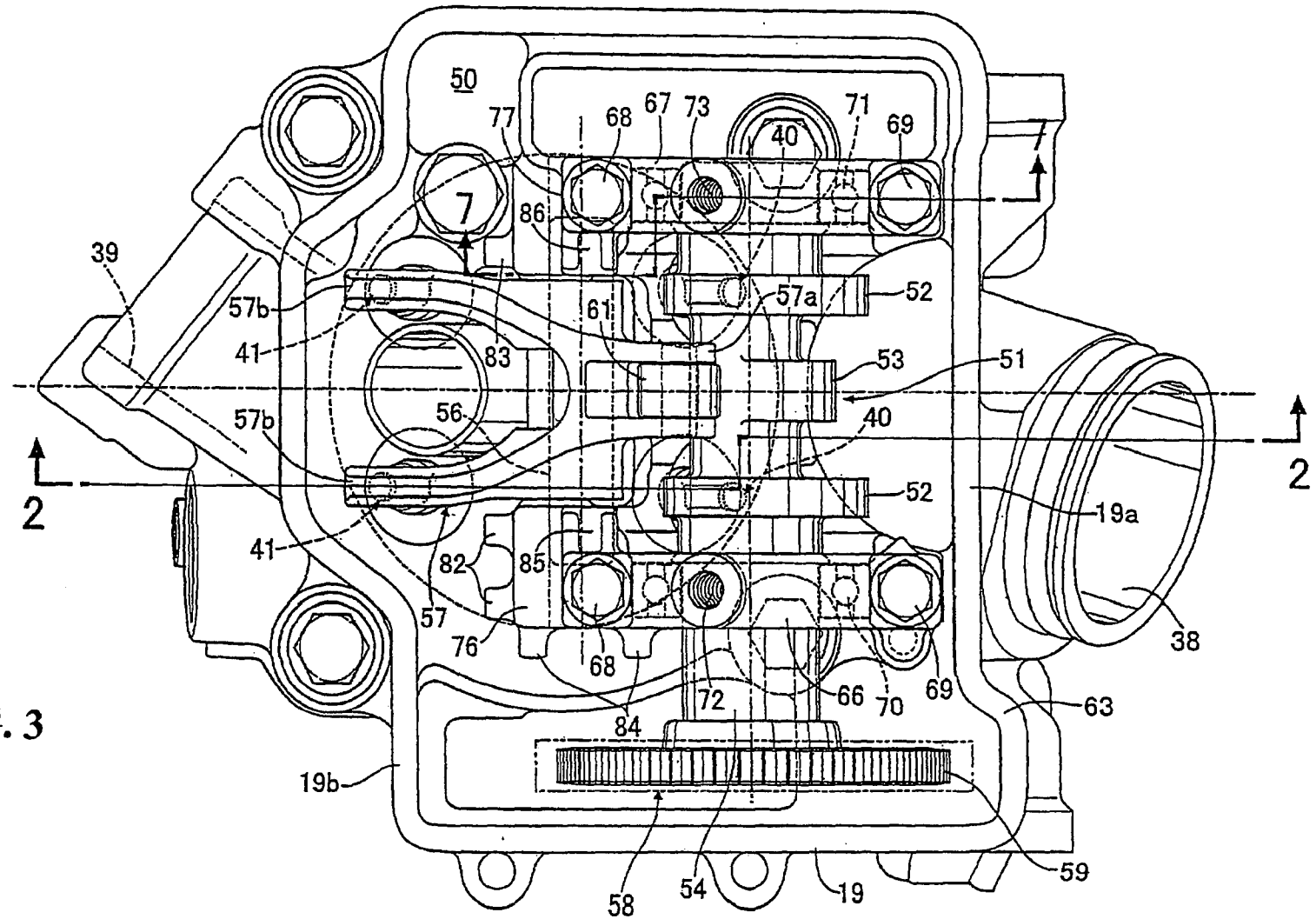
FIG. 3 is a plan view showing a cylinder head as viewed on arrows of line 3-3 of FIG. 2.

Referring also to FIG. 3, the intake valves 40 and the exhaust valves 41 are driven to open or close by a valve actuating system 51 accommodated in a valve train chamber 50 formed between the cylinder head 19 and the head cover 20. The valve actuating system 51 includes a camshaft 54, a pair of valve lifters 55, and a rocker arm 57. The camshaft 54 has an axis that extends in parallel with the crankshaft 16. Further, the camshaft 54 includes a pair of intake-side valve actuating cams 52, 52 and a single exhaust-side valve actuating cam 53. The pair of valve lifters 55 is fitted slidably into the cylinder head 19 to intervene between the two intake-side valve actuating cams 52 and the two intake valves 40. The rocker arm 57 is disposed between the exhaust-side valve actuating cam 53 and the exhaust valves 41 and rockably supported by a rocker shaft 56 having an axis that extends in parallel with the camshaft 54.

The camshaft 54 is disposed on an extension from an open/close operation axis of the intake valves 40, more specifically, an axis of the stems 42. The camshaft 54 has a first end to which a driven sprocket 59 is fixed. The driven sprocket 59 forms part of a timing transmission means 58 for transmitting a rotational power from the crankshaft 16 to the camshaft 54 at a reduction ratio of 1/2. Each of the valve lifters 55 is formed into a cylindrical shape with a bottom having on one end thereof an end wall 55*a* wherein an outer surface of the end wall 55*a* is in sliding contact with a corresponding one of the intake-side valve actuating cams 52, 52. The valve lifter 55 is fitted into the cylinder head 19, while being slidable along the open/close operational axis of the intake valve 40. Each of the stem ends 42*a* of the intake valves 40 abuts against an inner surface of a corresponding one of the end wall 55*a* of the valve lifters 55.

The rocker arm 57 integrates a cam abutment portion 57*a* and a pair of valve abutment portions 57*b*, 57*b*. The cam abutment portion 57*a* journals rotatably a roller 61 that makes a rolling contact with the exhaust-side valve actuating cam 53. The pair of valve abutment portions 57*b*, 57*b* is bifurcated from the cam abutment portion 57*a* such that each of the valve abutment portions 57*b*, 57*b* abuts on a corresponding one of the stem ends 43*a* of the exhaust valves 41. The rocker arm 57 is thus rockably journaled by the rocker shaft 56 disposed between the exhaust valves 41 and the camshaft 54.

Figure 4:
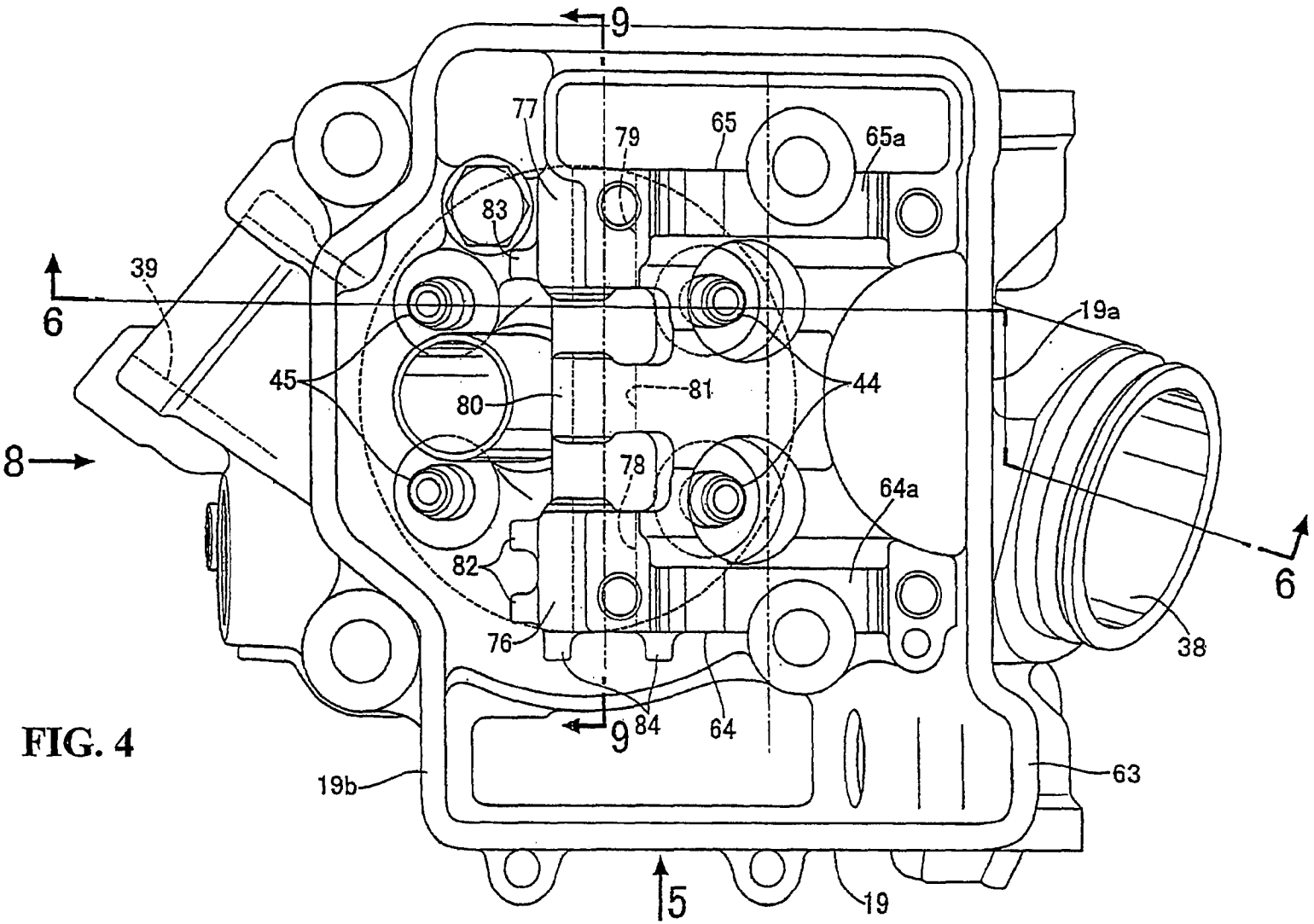
FIG. 4 is a plan view showing the cylinder head of FIG. 3 with a camshaft, a rocker arm, and a rocker shaft omitted.
Figure 5:
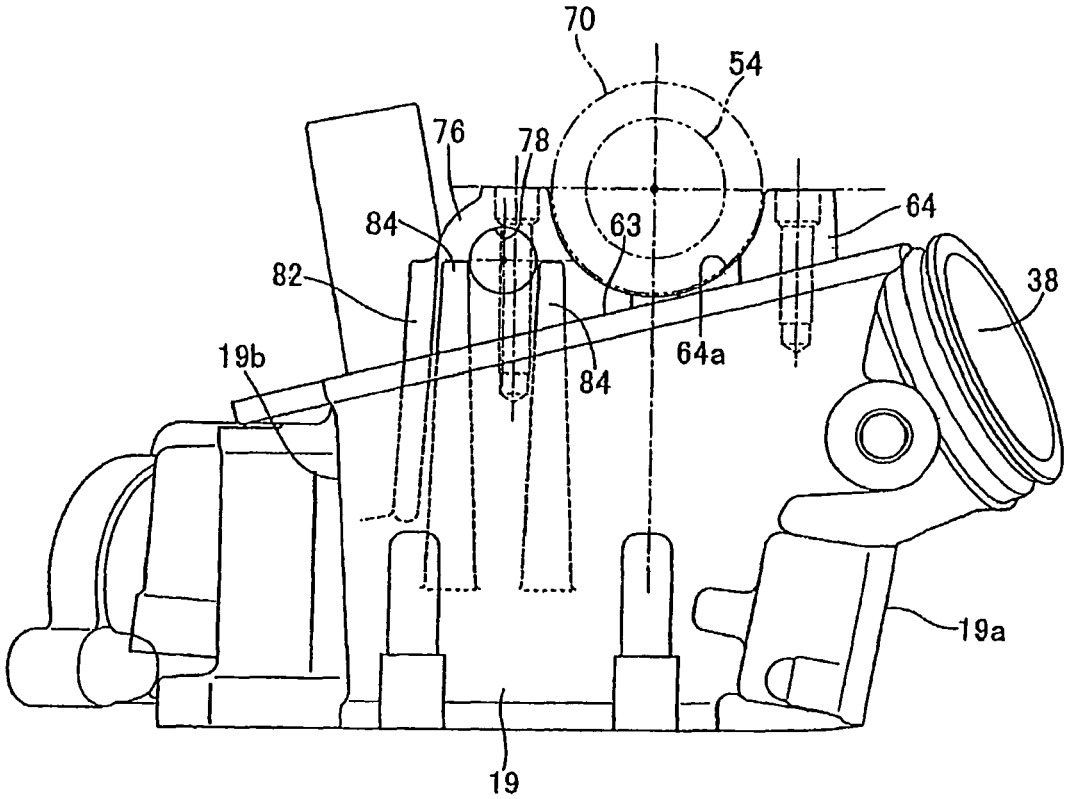
FIG. 5 is a view on arrow 5 of FIG. 4.

Referring also to FIGS. 4 and 5, the cylinder head 19 includes first and second side walls 19*a*, 19*b*, each extending in a direction along the axis of the camshaft 54 and mutually opposing each other. The intake port 38 is disposed in the first side wall 19*a*. The exhaust port 39 is disposed in the second side wall 19*b*.

Note also that the head cover 20 is connected to an upper end of the cylinder head 19 via a gasket 62. A connection surface 63 for connecting the head cover 20 is formed on the upper end of the cylinder head 19. The connection surface 63 is set so as to follow along a plane inclined to be spaced further away from the cylinder block 18 toward the first side wall 19*a* relative to the second side wall 19*b*.

The stem ends 43*a* of the exhaust valves 41 are disposed at positions protruding from the connection surface 63 as viewed in a direction along the axis of the camshaft 54. Further, the stems 43 of the exhaust valves 41 are formed to be shorter in length than the stems 42 of the intake valves 40.

Figure 6:
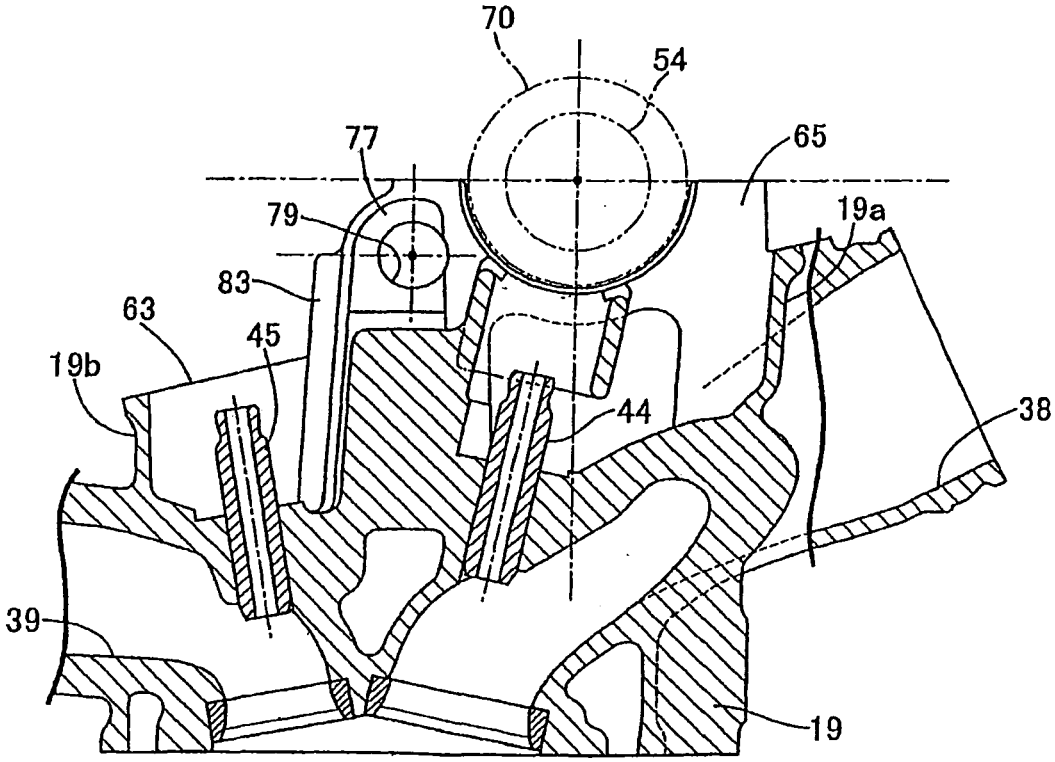
FIG. 6 is a cross-sectional view taken along line 6-6 of FIG. 4.
Figure 7:
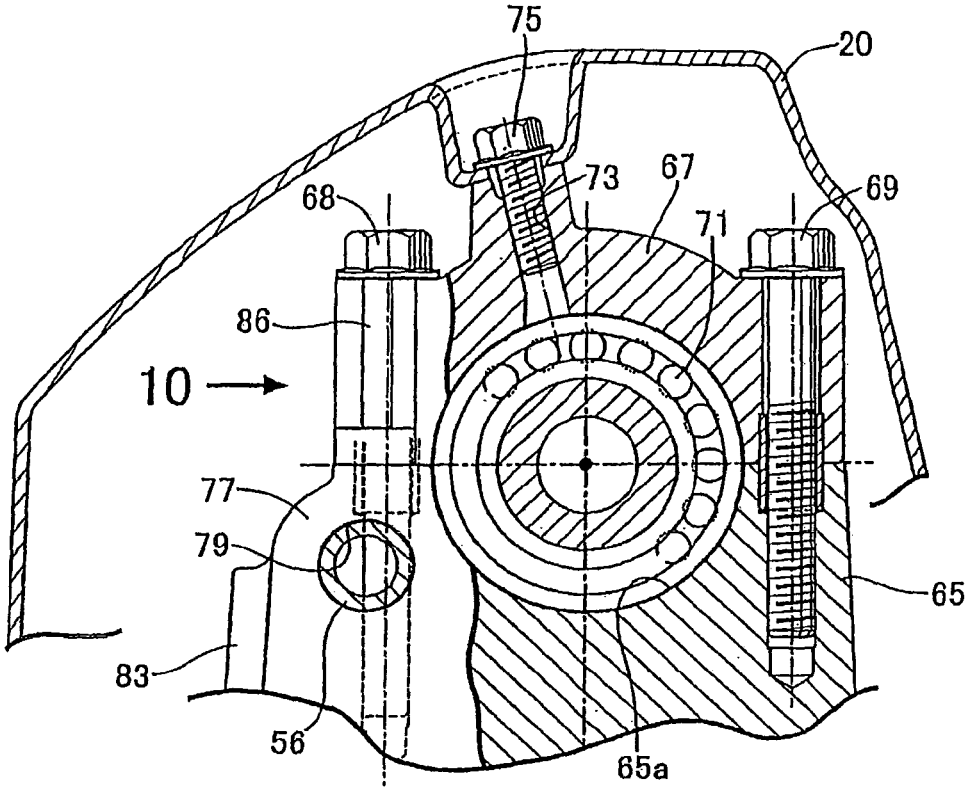
FIG. 7 is a cross-sectional view taken along line 7-7 of FIG. 3.

Referring also to FIGS. 6 and 7, the camshaft 54 is rotatably supported by a pair of camshaft holders 64, 65 and cam caps 66, 67. More specifically, the camshaft holders 64, 65 are integrated with the cylinder head 19 in a protruding condition at positions spaced apart from each other in the axial direction of the camshaft 54. The cam caps 66, 67 are fastened to the camshaft holders 64, 65, respectively, using each pair of bolts 68, 69 disposed on either side of the camshaft 54. Accordingly, the camshaft holders 64, 65 include semi-circular bearing portions 64*a*, 65*a* that receive a substantially half portion of the camshaft 54. The cam caps 66, 67 receiving a remainder substantially half portion of the camshaft 54 are fastened to the camshaft holders 64, 65 with each of the pair of bolts 68, 69 disposed on either side of the camshaft 54. Further, ball bearings 70, 71 are inserted between the camshaft holders 64, 65 and the cam caps 66, 67.

The cam caps 66, 67 include threaded holes 72, 73 formed therein, respectively. Bolts 75 that are passed through and engaged with the head cover 20 are threaded into the threaded holes 72, 73, respectively. Tightening the bolts 75 results in the head cover 20 being connected to the connection surface 63 of the cylinder head 19 via the gasket 62.

The camshaft holders 64, 65 are integrally connected to the first side wall 19*a* of the cylinder head 19. Further, the camshaft holders 64, 65 are integrated with the cylinder head 19 in a protruding condition so as to protrude from the connection surface 63 as viewed from the axial direction of the camshaft 54. The bearing portions 64*a*, 65*a* of the camshaft holders 64, 65 are disposed at a position protruding from the connection surface 63 as viewed from the axial direction of the camshaft 54.

The intake port 38 is disposed in the first side wall 19a such that an upstream end thereof is disposed at the same position as that at which part of the bearing portions 64*a*, 65*a* of the camshaft holders 64, 65 is disposed in a direction along an axis C of the cylinder bore 35. Additionally, the intake port 38 has an upper end disposed upward of a position of a lower end of the camshaft 54. Specifically, the upper end of the intake port 38 is disposed upward of a horizontal line L that passes through the lower end of the camshaft 54 upon which actuating cam 53 is disposed. (See FIG. 2.)

The rocker shaft 56 is supported by the cylinder head 19 by being disposed at a position protruding from the connection surface 63 as viewed from the axial direction of the camshaft 54. A pair of rocker shaft support portions 76, 77 supporting the rocker shaft 56 is integrated with the cylinder head 19 so as to be disposed between the exhaust valves 41 and the camshaft 54 as viewed from the axial direction of the camshaft 54 and the rocker shaft 56.

Figure 8:
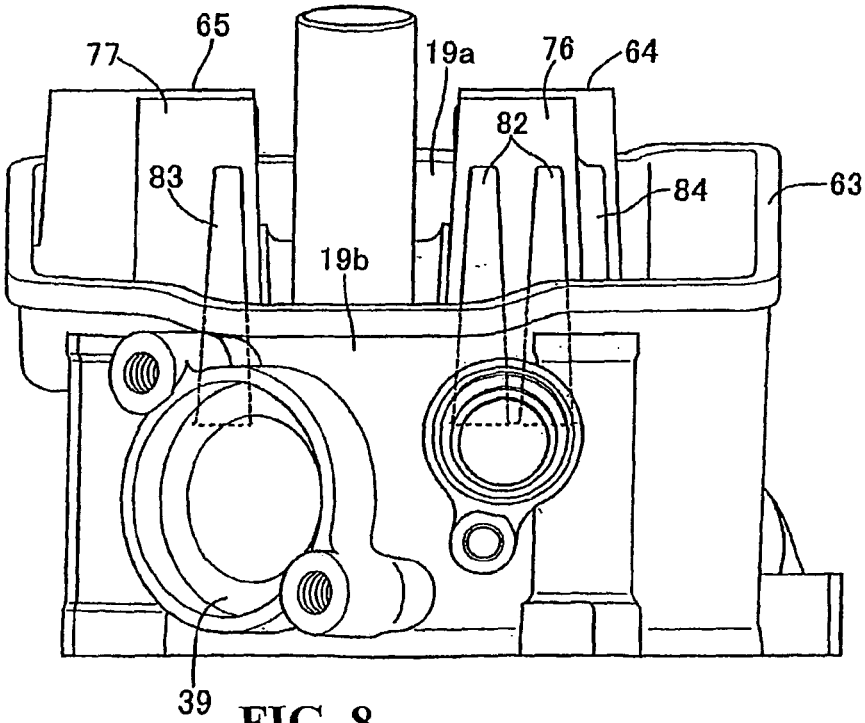
FIG. 8 is a view on arrow 8 of FIG. 4.
Figure 9:
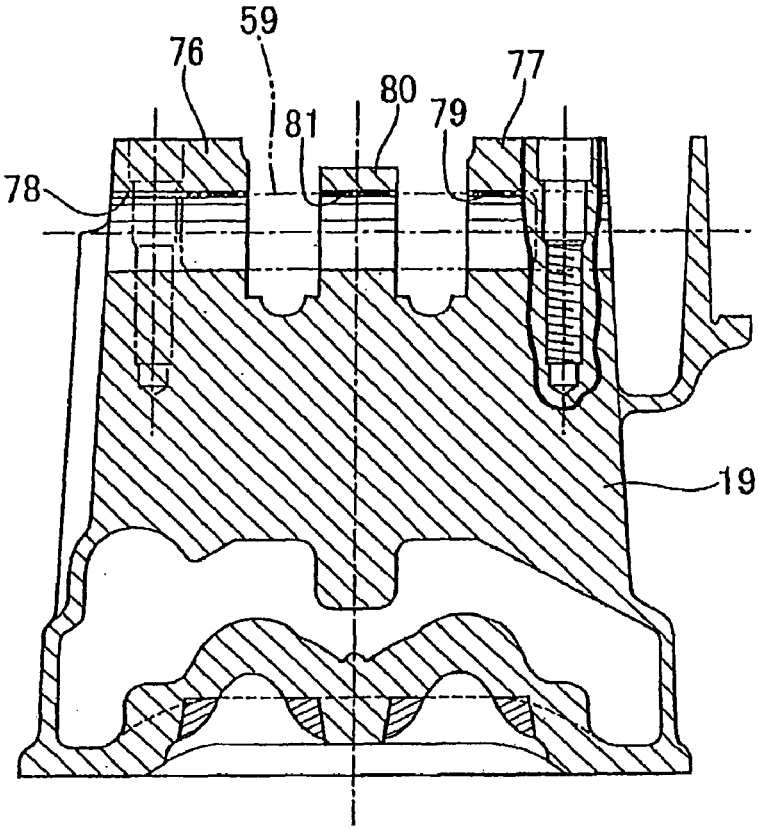
FIG. 9 is a cross-sectional view taken along line 9-9 of FIG. 4.

Referring also to FIGS. 8 and 9, the rocker shaft support portions 76, 77 are integrated continuously with the camshaft holders 64, 65 to rockably support both ends of the rocker shaft 56. The rocker shaft support portions 76, 77 include support holes 78, 79, respectively, formed therein coaxially therewith for supporting the rocker shaft 56. Of each pair of bolts 68, 69 for fastening the cam caps 66, 67 to the camshaft holders 64, 65, the bolts 68 engage with both ends of the rocker shaft 56 that is passed through the support holes 78, 79, thereby securing the rocker shaft 56 to the rocker shaft support portions 76, 77.

The rocker arm 57 is disposed between the rocker shaft support portions 76, 77. The cylinder head 19 includes a rocker shaft center support portion 80 integrally formed therewith between the rocker shaft support portions 76, 77. The rocker shaft center support portion 80 has a support hole 81 coaxial with the support holes 78, 79. The rocker shaft center support portion 80 supports the rocker shaft 56 at an axial central portion thereof.

The rocker shaft support portion 76 of the two rocker shaft support portions 76, 77 has a side face opposite the camshaft 54, on which a pair of first reinforcement ribs 82, 82 is disposed. The first reinforcement ribs 82, 82 are provided integrally on a plane that is orthogonal to the axis of the rocker shaft 56. The other rocker shaft support portion 77 has a side face opposite the camshaft 54, on which a first reinforcement rib 83 is disposed. The first reinforcement rib 83 is provided integrally on a plane that is orthogonal to the axis of the rocker shaft 56.

At least one of the two rocker shaft support portions 76, 77, more specifically, the one rocker shaft support portion 76 according to the embodiment of the present invention has a side face opposite the rocker arm 57, on which a pair of second reinforcement ribs 84, 84 is disposed. The second reinforcement ribs 84, 84 are provided integrally on a plane that is in parallel with the axis of the rocker shaft 56.

Figure 10:
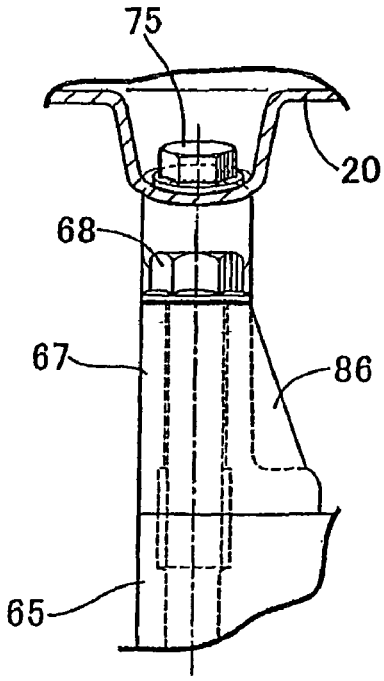
FIG. 10 is a view on arrow 10 of FIG. 7.

Referring also to FIG. 10, the cam caps 66, 67 which are fastened, respectively, to the camshaft holders 64, 65 includes third reinforcement ribs 85, 86 formed integrally thereon in a protruding condition. The third reinforcement ribs 85, 86 protrude in a direction along the axis of the camshaft 54 from portions of the cam caps 66, 67 fastened to the camshaft holders 64, 65 by the bolts 68 . . . . The third reinforcement ribs 85, 86 abut on the rocker shaft support portions 76, 77, respectively.

The effects of the cylinder head structure according to the embodiment of the present invention will be described below. More specifically, the connection surface 63 formed on the cylinder head 19 for connecting the head cover 20 is set so as to follow along the plane inclined to be spaced further away from the cylinder block 18 toward the first side wall 19*a* relative to the second side wall 19*b*. The camshaft holders 64, 65 including the semi-circular bearing portions 64*a*, 65*a* that receive a substantially half portion of the camshaft 54 and the stem ends 43*a* of the exhaust valves 41 protrude from the connection surface 63 as viewed in the direction along the axis of the camshaft 54. The cylinder head 19 can therefore be further reduced in size and weight.

The intake port 38 is disposed in the first side wall 19*a* such that the upstream end thereof is disposed at the same position as that at which part of the bearing portions 64*a*, 65*a* of the camshaft holders 64, 65 is disposed in the direction along the axis C of the cylinder bore 35. A flow direction in the intake port 38 is sharply inclined at a side close to the cylinder axis, thereby ensuring a good introduction of fuel into the combustion chamber 37 for an enhanced engine performance in a low-to-medium speed range.

The camshaft holders 64, 65 are integrally connected with the first side wall 19*a* to be integrated with the cylinder head 19 in a protruding condition. Thus, the stiffness of the camshaft holders 64, 65 can therefore be enhanced such that the camshaft holders 64, 65 are reinforced with the first side wall 19*a*.

The valve actuating system 51 driving to open or close the exhaust valves 41 includes the rocker shaft 56 having the axis extending in parallel with the camshaft 54 and supported by the cylinder head 19 by being disposed at a position protruding from the connection surface 63 as viewed from the axial direction of the camshaft 54 and the rocker arm 57 rotatably supported by the rocker shaft 56 so as to rock by following rotation of the exhaust-side valve actuating cam 53 disposed on the camshaft 54. The stems 43 of the exhaust valves 41 driven to open or close by the rocker arm 57 are formed to be shorter in length than the stems 42 of the intake valves 40. This allows the exhaust valves 41 to be reduced in weight for the improved operating response of the exhaust valves 41 at a high speed range. The stem ends 43*a* of the exhaust valves 41 are disposed at positions protruding from the connection surface 63 despite the shorter length of the stems 43 of the exhaust valves 41. This arrangement allows a tappet clearance between the rocker arm 57 and the stem ends 43*a* to be easily checked.

In addition, the bearing portions 64*a*, 65*a* of the camshaft holders 64, 65 are disposed at a position protruding from the connection surface 63 as viewed from the axial direction of the camshaft 54. Thus, the machinability of the bearing portions 64*a*, 65*a* can therefore be improved.

The rocker shaft support portions 76, 77 supporting the rocker shaft 56 are integrated with the cylinder head 19 so as to be disposed between the exhaust valves 41 and the camshaft 54 as viewed from the axial direction of the camshaft 54 and the rocker shaft 56. The first reinforcement ribs 82, 82, 83 are integrally disposed in a protruding condition on the plane that is orthogonal to the axis of the rocker shaft 56 on the side face of the rocker shaft support portions 76, 77 opposite the camshaft 54. This enhances the stiffness of the rocker shaft support portions 76, 77, while avoiding an increase in size of the rocker shaft support portions 76, 77 and, for that matter, an increase in size of the cylinder head 19. This arrangement improves the operating response of the exhaust valves 41.

The pair of rocker shaft support portions 76, 77 that rockably support both ends of the rocker shaft 56 are integrated with the cylinder head 19 such that the rocker arm 57 is disposed between the rocker shaft support portions 76, 77. The second reinforcement ribs 84, 84 are integrally disposed in a protruding condition on the plane that is in parallel with the axis of the rocker shaft 56 on the side face opposite the rocker arm 57 of at least one of the two rocker shaft support portions 76, 77, more specifically, the rocker shaft support portion 76. This allows the second reinforcement ribs 84 to prevent the rocker shaft support portion 76 from being tilted by a load acting on the rocker shaft 56 from the rocker arm 57 between the two rocker shaft support portions 76, 77. Stiffness of the rocker shaft support portion 76 can be enhanced with the structure that includes the second reinforcement ribs 84 integrated with the rocker shaft support portion 76 in a protruding condition to thereby avoid increasing the size.

The camshaft holders 64, 65, integrally connected to the rocker shaft support portions 76, 77, are integrated with the cylinder head 19. The cam caps 66, 67 that cooperate with the camshaft holders 64, 65 to rotatably support the camshaft 54 are fastened to the camshaft holders 64, 65. The third reinforcement ribs 85, 86 that protrude in the direction along the axis of the camshaft 54 from the portions of the cam caps 66, 67 fastened to the camshaft holders 64, 65 are integrated with the cam caps 66, 67 in a protruding condition and abut on the rocker shaft support portions 76, 77, respectively. The rocker shaft support portions 76, 77 can therefore be further reinforced with the third reinforcement ribs 85, 86. Thus, the stiffness of the rocker shaft support portions 76, 77 can be further enhanced, so that the operating response of the engine valves can be further enhanced.

The rocker shaft center support portion 80 that supports the rocker shaft 56 at the axial central portion thereof is integrated with the cylinder head 19 between the rocker shaft support portions 76, 77. This prevents the rocker shaft 56 from being flexed.

The embodiment of the present invention has been described with reference to the exhaust valve 41 that serves as the engine valve. The present invention can still be embodied in association with the intake valve 40 that serves as the engine valve.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rocker shaft support structure in a four-cycle engine, the four-cycle engine comprising:

a rocker arm inserted between a valve actuating cam disposed on a camshaft and an engine valve, the rocker arm being rockably supported on a rocker shaft having an axis substantially parallel with the camshaft; and rocker shaft support portions integrally formed on a cylinder head so as to be disposed between the engine valve and the camshaft as viewed from an axial direction of the camshaft and the rocker shaft, the rocker shaft support portions supporting the rocker shaft;

wherein first reinforcement ribs are integrally disposed in a protruding condition on a plane orthogonal to the axis of the rocker shaft on a forward side face of the rocker shaft support portions opposite a side of the camshaft;

wherein the first reinforcement ribs disposed on rocker shaft support portions of the cylinder head extend lengthwise in an up and down direction along the forward side of the rocker shaft support portions.

2. The rocker shaft support structure in the four-cycle engine according to claim 1, wherein a pair of the rocker shaft support portions rockably supporting both ends of the rocker shaft is integrally formed on the cylinder head such that the rocker arm is disposed between the rocker shaft support portions;

the first reinforcement ribs extend downwardly below a lower-most portion of a spring of the engine valve; and a second reinforcement rib disposed on a plane that is in parallel with the axis of the rocker shaft is integrally formed in a protruding condition on a side face of at least one rocker shaft support portion opposite a side of the rocker arm.

3. The rocker shaft support structure in the four-cycle engine according to claim 1, wherein the cylinder head includes camshaft holders integrally formed thereon, the camshaft holders being integrally connected to the rocker shaft support portions;

cam caps are fastened to the camshaft holders, the cam caps cooperating with the camshaft holders to rotatably support the camshaft; and third reinforcement ribs are integrally formed on the cam caps in a protruding condition, the third reinforcement ribs protruding in a direction along the axis of the camshaft from portions of the cam caps fastened to the camshaft holders and abutting on the rocker shaft support portions.

4. The rocker shaft support structure in the four-cycle engine according to claim 2, wherein the cylinder head includes camshaft holders integrally formed thereon, the camshaft holders being integrally connected to the rocker shaft support portions;

cam caps are fastened to the camshaft holders, the cam caps cooperating with the camshaft holders to rotatably support the camshaft; and third reinforcement ribs are integrally formed on the cam caps in a protruding condition, the third reinforcement ribs protruding in a direction along the axis of the camshaft from portions of the cam caps fastened to the camshaft holders and abutting on the rocker shaft support portions.

5. The rocker shaft support structure in the four-cycle engine according to claim 2, wherein the cylinder head further includes a rocker shaft center support portion integrally formed therewith between the rocker shaft support portions, the rocker shaft center support portion supporting the rocker shaft at an axial central portion thereof.

6. The rocker shaft support structure in the four-cycle engine according to claim 3, wherein the camshaft holders are semi-circular bearing portions for receiving substantially one-half portion of the camshaft.

7. The rocker shaft support structure in the four-cycle engine according to claim 4, wherein the camshaft holders are semi-circular bearing portions for receiving substantially one-half portion of the camshaft.

8. The rocker shaft support structure in the four-cycle engine according to claim 6, wherein said cam caps receive substantially the remaining portion of the camshaft for rotatably mounting the camshaft relative to the semi-circular bearing portions and the cam caps.

9. The rocker shaft support structure in the four-cycle engine according to claim 7, wherein said cam caps receive substantially the remaining portion of the camshaft for rotatably mounting the camshaft relative to the semi-circular bearing portions and the cam caps.

10. The rocker shaft support structure in the four-cycle engine according to claim 2, wherein the second reinforcement ribs prevent the rocker shaft support portion form being tilted by a load acting on the rocker shaft from the rocker arm between the two rocker shaft support portions.

11. A rocker shaft support structure for an engine comprising:

a valve actuating cam disposed on a camshaft;

an engine valve;

a rocker arm inserted between the valve actuating cam disposed on the camshaft and the engine valve;

a rocker shaft having an axis substantially parallel with the camshaft, said rocker arm being rockably supported on the rocker shaft; and a pair of rocker shaft support portions integrally formed on left and right portions of a cylinder head and positioned to be between the engine valve and the camshaft as viewed from an axial direction of the camshaft and the rocker shaft, the rocker shaft support portions supporting the rocker shaft;

wherein first reinforcement ribs are integrally disposed to project on a plane orthogonal to the axis of the rocker shaft on a forward side face of the rocker shaft support portions opposite a side of the camshaft;

wherein the cylinder head further includes a rocker shaft center support portion integrally formed therewith between the pair of rocker shaft support portions, the rocker shaft center support portion supporting the rocker shaft at an axial central portion thereof.

12. The rocker shaft support structure for an engine according to claim 11, wherein a pair of the rocker shaft support portions rockably supporting both ends of the rocker shaft is integrally formed on the cylinder head such that the rocker arm is disposed between the rocker shaft support portions;

wherein the first reinforcement ribs extend lengthwise in an up and down direction along the forward side of the rocker shaft support portions, and extend downwardly below a lower-most portion of a spring of the engine valve; and a second reinforcement rib disposed on a plane that is in parallel with the axis of the rocker shaft is integrally formed in a protruding condition on a side face of at least one rocker shaft support portion opposite a side of the rocker arm.

13. The rocker shaft support structure for an engine according to claim 11, wherein the cylinder head includes camshaft holders integrally formed thereon, the camshaft holders being integrally connected to the rocker shaft support portions;

cam caps are fastened to the camshaft holders, the cam caps cooperating with the camshaft holders to rotatably support the camshaft; and third reinforcement ribs are integrally formed on the cam caps in a protruding condition, the third reinforcement ribs protruding in a direction along the axis of the camshaft from portions of the cam caps fastened to the camshaft holders and abutting on the rocker shaft support portions.

14. The rocker shaft support structure for an engine according to claim 12, wherein the cylinder head includes camshaft holders integrally formed thereon, the camshaft holders being integrally connected to the rocker shaft support portions;

cam caps are fastened to the camshaft holders, the cam caps cooperating with the camshaft holders to rotatably support the camshaft; and third reinforcement ribs are integrally formed on the cam caps in a protruding condition, the third reinforcement ribs protruding in a direction along the axis of the camshaft from portions of the cam caps fastened to the camshaft holders and abutting on the rocker shaft support portions.

15. The rocker shaft support structure for an engine according to claim 13, wherein the camshaft holders are semi-circular bearing portions for receiving substantially one-half portion of the camshaft.

16. The rocker shaft support structure for an engine according to claim 14, wherein the camshaft holders are semi-circular bearing portions for receiving substantially one-half portion of the camshaft.

17. The rocker shaft support structure for an engine according to claim 15, wherein said cam caps receive substantially the remaining portion of the camshaft for rotatably mounting the camshaft relative to the semi-circular bearing portions and the cam caps.

18. The rocker shaft support structure in the four-cycle engine according to claim 16, wherein said cam caps receive substantially the remaining portion of the camshaft for rotatably mounting the camshaft relative to the semi-circular bearing portions and the cam caps.

19. The rocker shaft support structure for an engine according to claim 12, wherein the second reinforcement ribs prevent the rocker shaft support portion form being tilted by a load acting on the rocker shaft from the rocker arm between the two rocker shaft support portions.

* * * * *